United States Patent [19]

Hayden

[11] 3,979,705

[45] Sept. 7, 1976

[54] AUTOMOTIVE RELAY OF THE HOLD-IN TYPE

[75] Inventor: Rodney Hayden, Stoney Creek, Canada

[73] Assignee: TRW Inc., Cleveland, Ohio

[22] Filed: Apr. 3, 1975

[21] Appl. No.: 564,589

[30] Foreign Application Priority Data

May 13, 1974 Canada ..... 199703

[52] U.S. Cl. ..... 335/151; 335/154; 335/187

[51] Int. Cl.[2] ..... H01H 1/66; H01H 51/00

[58] Field of Search ..... 335/151, 154, 187, 203

[56] References Cited

UNITED STATES PATENTS

| | | | |
|---|---|---|---|
| 3,128,355 | 4/1964 | Fuller | 335/203 X |
| 3,568,008 | 3/1971 | Tanimura | 335/151 X |
| 3,588,765 | 6/1971 | Alten | 335/203 |
| 3,812,439 | 5/1974 | Parmenter | 335/151 |

*Primary Examiner*—George Harris
*Attorney, Agent, or Firm*—James R. O'Connor

[57] ABSTRACT

A hold-in type of automotive relay which when actuated by a first switch controlled exciting current closes its normally open relay contacts and a second switch magnetically connected to said relay and the source of current. The contacts of the second switch remain closed even after the first switch is opened and until such time as the current passing through the second switch is interrupted.

3 Claims, 3 Drawing Figures

FIG 1
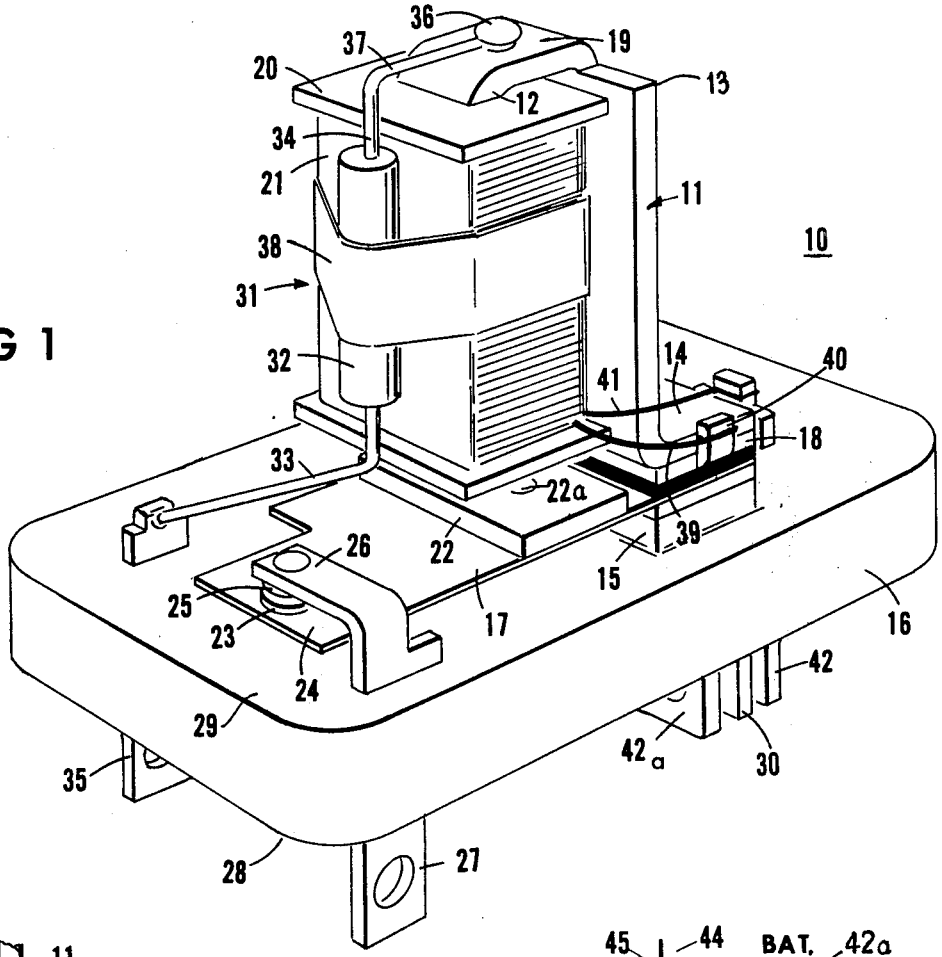
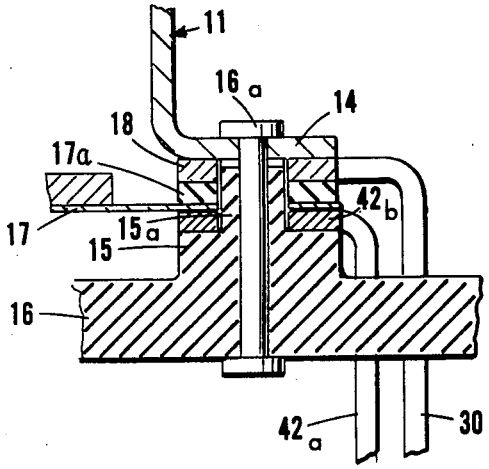
FIG 3
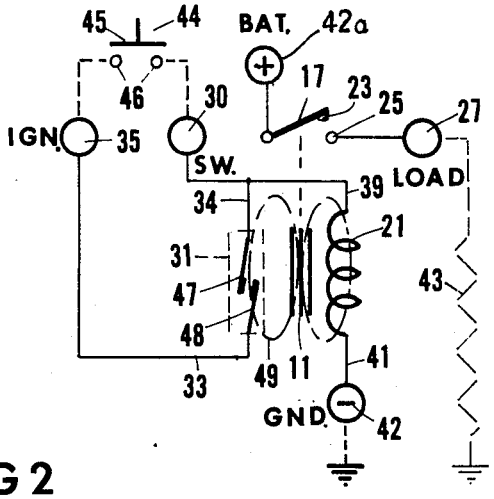
FIG 2

AUTOMOTIVE RELAY OF THE HOLD-IN TYPE

BACKGROUND OF THE INVENTION

This invention relates to the automotive relay of the hold-in type which once actuated to cause its normally open relay contacts to close maintains such contacts in closed relationship upon the removal of switch controlled exciting current. Thus the relay of the invention may be actuated by a momentary exciting pulse on its input terminal but will remain a circuit on its output terminal excited thereafter.

Electrical and electronic circuits for causing a normally open relay to maintain its contacts closed when the relay has been momentarily energized are well known. The number of electrical or electronic components required to accomplish such function adds substantial cost to a relay structure to be provided for use in automotive applications. Generally, this functional result may be accomplished simply by the use of two relays wherein an additional relay switches a first relay from an exciting source to the continuous source. The substitute electronic structure for the additional relay operates essentially in the same way. However, there is a demand for a relay structure having a battery or ignition terminal, an actuating terminal, an output load terminal and a ground terminal to be so organized in its function and structure on a single support base as to provide a hold-in function to connect the output terminal to the battery or ignition terminal once an exciting pulse is applied to the actuating terminal to energize the relay momentarily.

SUMMARY OF THE INVENTION

A hold-in type of direct current automotive relay having a normally open relay supported on an insulate base and five connecting terminals extending from said base including an ignition terminal, a switch terminal, a load terminal, a battery terminal and a ground terminal. The battery and the load terminals are connected by the normally open contacts of the relay. The switch terminal is connected to the ground terminal through a relay winding and to the ignition terminal through a normally open magnetic flux actuable switch device. The last-mentioned device is located within the influence of the magnetic field generated by the relay winding upon the latter being electrically energized. The switch device thus serves to hold the relay in the closed condition connecting the battery terminal and the load terminal until the ground terminal or the ignition terminal is disconnected.

BRIEF DESCRIPTION OF THE DRAWING

FIG. 1 is a perspective view of the hold-in relay structure of the invention with its cover removed;

FIG. 2 is an electrical schematic diagram of the relay structure of FIG. 1; and

FIG. 3 is a sectional view of the structural connection of the relay core, the relay armature, the switch terminal, and the battery terminal to the relay base.

DESCRIPTION OF A PREFERRED EMBODIMENT

The hold-in type of automotive relay structure 10 of the invention includes a ferrous core 11 of generally inverted U-shape configuration defined by spaced apart arm members 12 and 13, the arm member 13 having a supporting flange 14 riveted to a riser portion 15 of a rectangular insulate base to clamp the cantilever spring armature 17 beneath an abutment plate 18. The free arm 12 is joined to the fixed arm 13 by the bridge member 19 forming a part of said core and supports an insulate coil form 20 which carries relay winding 21. Relay armature 17 carries a movable core part 22 fastened thereto such as by spot welding **22*a* and adapted when said winding 21 is energised to draw the armature 17 and its movable contact 23 on the free end thereof upwardly for engagement with fixed contact 25 rigidly carried by contact arm 26 extending through base 16 to a load terminal 27 extending from the outer face 28 of base 16, the face 29** of said base being considered to be the inner face thereof.

The abutment plate 18 serves as an electrical connection to core 11 by way of the switch terminal leg 30 forming a part thereof and extending through base 16 outwardly of and beyond outer face 28. A normally open magnetic flux actuable reed switch 31 having an inert gas containing capsule body 32 within which conventional, normally open, single throw reed switch arms are mounted (not shown, see General Electric Reed Switches Bulletin ETD-4409 A 5. 10/8) has current and magnetic flux conducting leads 33, 34. The lead 33 is connected to ignition terminal 35 extending through base 16, the lead 34 is connected for close flux associated with the core bridge 19, preferably by a brass rivet 36. The connecting arm portion 37 of lead 34 is positioned by such connection for alignment with the magnetic flux lines generated by the winding 21 and the core arm 12 when said winding is energized. It has been found that the alignment of at least one of the leads 33 or 34 with the flux lines generated by the winding 21 markedly increases the sensitivity of the reed switch 31 to magnetic flux actuation. Preferably also the reed switch body 32 is fastened firmly in close association with winding 21 by means of an adhesive strip 38 or other suitable nonmagnetic means. One of the winding leads 39 is electrically connected to lug 40 of abutment plate 18 and switch terminal 30. The other winding lead 41 connects to a ground terminal 42 extending through base 16.

As depicted in the circuit of FIG. 2, armature 17 connects to a battery terminal **42*a* and terminal 27 is adapted to act as a terminal for an external load 43 indicated in chain lines. Terminal 42 is adapted to be connected to ground. Terminal 35 is adapted to be connected to the ignition switch and switch terminal 30 to an external normally open push-button switch 44 having an armature 45 and mutually actuable normally open contacts 46. Accordingly, momentary manual closure of switch 44 will connect ignition terminal 35 to switch terminal 30 whereupon winding 21 connected between switch terminal 30 and ground terminal 42 is energized closing normally open relay contacts 23 and 25 by actuating relay armature 17 and simultaneously closing the normally open reed switch contacts 47, 48 by reason of their response to magnetic flux 49 generated by winding 21. The closure of reed switch contacts 47, 48 connects ignition terminal 35 to switch terminal 30 through the reed switch. Thus the reed switch shunts the ignition terminal and switch terminal whereby so long as flux is generated by winding 21 the relay armature contacts 23 and 25 will remain closed and load 43 on load terminal 27 will be energized through battery terminal 42*a*. The load 43 will remain energized so long as the contacts of reed switch 31 and the relay armature contacts remain closed, i.e., until the ignition switch is turned off disconnecting terminal 35 from battery power or ground is removed from terminal 42.**

As seen in FIG. 3, base riser portion 15 embodies hollow insulate tubular structures 15*a* rising thereabove over which are mounted apertured flange 42*b* of battery terminal leg 42*a* supporting armature 17 which is similarly apertured and is covered by a layer of insulation 17*a* which in turn supports apertured abutment plate 18 of switch terminal leg 30. The abutment plate 18 is connected to mounting flange 14 of core 11 and the entire assembly is fastened by rivets 16*a* between flange 14 and base 16.

I claim:

1. An automotive relay structure of the hold-in type comprising: a relay unit having a ferrous core and a relay winding on said core; a movable armature fastened to said core and carrying a movable core part and having a relay contact on the free end thereof; an insulate base rigidly supporting said relay unit on one face of said base; at least five rigid terminal members extending from said face through said base to provide male terminal members extending beyond the other surface of said base; one of said terminal members being a load terminal carrying a stationary contact disposed in normally open, spaced relationship to said movable contact on the free end of said armature, another of said terminals being a battery terminal which is connected to said armature, another of said terminals being a switch terminal connected to one end of said relay winding and to an external switch; a normally open flux responsive reed switch having current and flux conducting leads extending therefrom, one of said leads being rigidly connected to still another of said terminals which is an ignition terminal, and the other of said leads being connected to said switch terminal; and means supporting said reed switch within the influence of a magnetic field generated by said relay winding whereby a momentary closing of an external switch connects said switch terminal to said ignition terminal which energizes the coil and effects a closing of said relay armature contact and said load contact, and simultaneous closure of said reed switch responsive to flux generated by the relay winding thereby simultaneously connecting the reed switch between said ignition terminal and said switch terminal through said reed switch contacts until the battery is disconnected from said ignition terminal or ground removed.

2. A relay structure according to claim 1 wherein at least one of the reed switch leads is physically located in close proximity to the relay core.

3. A relay structure according to claim 2 wherein said one reed switch lead has a magnetic flux sensitive portion aligned with the direction of magnetic flux generated by said winding.

* * * * *